US006050681A

United States Patent [19]

Yamashita et al.

[11] Patent Number: 6,050,681

[45] Date of Patent: Apr. 18, 2000

[54] INK CARTRIDGE AND INK SUPPLYING APPARATUS

[75] Inventors: Takeshi Yamashita, Kawanishi; Hitoshi Kato, Itami; Tomoko Yamamoto, Takarazuka, all of Japan

[73] Assignee: Minolta Co., Ltd., Osaka, Japan

[21] Appl. No.: 09/006,406

[22] Filed: Jan. 13, 1998

[30] Foreign Application Priority Data

Jan. 14, 1997 [JP] Japan ..... 9-004292
Feb. 4, 1997 [JP] Japan ..... 9-021410

[51] Int. Cl.[7] ..... B41J 2/175

[52] U.S. Cl. ..... 347/86

[58] Field of Search ..... 347/84, 85, 86, 347/87

[56] References Cited

U.S. PATENT DOCUMENTS 4,156,244 5/1979 Erikson et al. ..... 347/86
5,500,665 3/1996 Ujita et al. ..... 347/86
5,781,213 7/1998 Ujita et al. ..... 347/86
5,912,687 6/1999 Cowger et al. ..... 347/85

FOREIGN PATENT DOCUMENTS 4-358842 12/1992 Japan .
7-017049 1/1995 Japan .
7-089087 4/1995 Japan .
7-241998 9/1995 Japan .

*Primary Examiner*—N. Le
*Assistant Examiner*—Judy Nguyen
*Attorney, Agent, or Firm*—Sidley & Austin

[57] ABSTRACT

In an ink cartridge, a holding section, containing a holding member for holding ink, is provided in the cartridge body; a supply port, for supplying the ink held in the holding member to the outside, and a cover member, for opening and closing the supply port, are provided in the holding section; and the cover member is urged by the holding member to close the supply port. Further, in an ink supplying apparatus, a guide pipe is provided in its apparatus body, and the guide pipe is inserted into the supply port to press the cover member into the holding section to open the supply port.

8 Claims, 11 Drawing Sheets

INK CARTRIDGE AND INK SUPPLYING APPARATUS

BACKGROUND OF THE INVENTION

This application is based on applications Nos. 4292/1997 and 21410/1997 filed in Japan, the contents of which are hereby incorporated by reference.

1. Field of the Invention

The present invention relates generally to an ink cartridge, used for supplying ink to a recording head in an ink jet recorder, and to an ink supplying apparatus using the ink cartridge, and more particularly, to an ink cartridge which is capable of stably supplying ink, contained in its cartridge body, to a recording head via a supply port and a supply pipe, which are provided in the cartridge body, as well as preventing the ink from independently leaking through the supply port and the supply pipe, and to an ink supplying apparatus using the ink cartridge.

2. Description of the Related Art

Conventionally, an ink jet recorder has been so adapted as to supply ink to a recording head from an ink supplying apparatus and to eject the ink from the recording head to make a recording.

In supplying the ink to the recording head from the ink supplying apparatus, an ink cartridge, containing ink in its cartridge body, is generally mounted on a mounting section, provided in an apparatus body of the ink supplying apparatus, to supply the ink contained in the ink cartridge to the recording head via the supply port, provided in the cartridge body, and through the apparatus body.

Conventionally in thus supplying the ink to the recording head from the supply port, provided in the cartridge body, through the apparatus body, a holding member, such as a sponge for holding the ink, has been generally contained in the cartridge body, to supply the ink held in the holding member to the apparatus body via the supply port and to introduce the ink to the recording head.

In thus supplying the ink, held in the holding member, to the apparatus body via the supply port and introducing the ink to the recording head, when the supply port is made large, the ink is sufficiently introduced into the recording head. In cases such as a case where the ink cartridge is removed from the mounting section in the apparatus body, however, the ink held in the holding member leaks out of the supply port.

On the other hand, when the supply port is made small in order to prevent the ink from leaking, the ink is not sufficiently introduced into the recording head in a case where printing is continuously done and in a case where purging is performed, so that stable recording cannot be made.

In recent years, an ink supplying apparatus has been developed which is so adapted that in introducing ink into a recording head from a containing section, for containing the ink, via a supply port, a sealing member made of rubber is pressed against a portion of the supply port by a compression spring to close the supply port, thereby preventing the ink contained in the containing section from leaking out of the supply port, as disclosed in JP-A-7-17049.

However, there are some problems. For example, it is extremely difficult to thus provide the compression spring in the vicinity of the supply port to close the supply port by the sealing member, the fabricating cost of an ink cartridge is high, and the ink contained in the containing section cannot be sufficiently prevented from leaking out of the supply port.

Conventional examples include an ink supplying apparatus so adapted that an ink cartridge, provided with a supply pipe in a portion of a supply port provided in its cartridge body, is mounted on a mounting section provided in its apparatus body, to introduce ink into a guide path, provided in the apparatus body, via the supply pipe and to supply the ink to a recording head via the guide path.

When the ink cartridge is thus mounted on the mounting section in the apparatus body, to supply the ink to the guide path from the supply pipe, air enters the guide path; the air thus entering the guide path is changed into air bubbles; and the air bubbles are introduced into the recording head, so that the recording head is clogged with the air bubbles. Therefore, the ink is not satisfactorily ejected from the recording head, resulting in insufficient printing, for example.

Furthermore, in cases such as a case where the ink cartridge, mounted on the mounting section in the apparatus body as described above, is removed, the ink remaining in a portion of the supply pipe spills.

SUMMARY OF THE INVENTION

An object of the present invention is to make it possible to make stable recording upon sufficiently supplying ink to a recording head from an ink cartridge even in a case where printing is continuously done and in a case where purging is performed.

Another object of the present invention is to prevent ink contained in an ink cartridge from independently leaking out of a supply port or a supply pipe which are provided in its cartridge body.

Still another object of the present invention is to make it possible to make stable recording upon satisfactorily ejecting ink from a recording head by eliminating, when an ink cartridge is mounted on a mounting section provided in an apparatus body of an ink supplying apparatus to supply ink to a guide path provided in the apparatus body from the ink cartridge, the possibility that even if air enters the guide path, the air, together with the ink, is introduced to the recording head, so that the recording head is clogged with air bubbles.

In a first ink cartridge according to the present invention, a holding section containing a holding member for holding ink is provided in its cartridge body.

Further, a supply port for supplying the ink held in the holding member to the outside, and a cover member for opening and closing the supply port are provided in the holding section. The cover member is urged by the holding member to close the supply port.

In an ink supplying apparatus using the first ink cartridge, a mounting section, for holding the ink cartridge so as to be removable, is provided in its apparatus body, and the mounting section is provided with a guide pipe. The guide pipe is inserted into the supply port, provided in the ink cartridge, to press the cover member into the holding section so as to open the supply port.

When the guide pipe provided in the mounting section is inserted into the supply port to open the supply port, the ink held in the holding member is led through the guide pipe.

In the ink supplying apparatus, the ink led through the guide pipe is introduced into the recording head.

On the other hand, when the ink cartridge, thus mounted on the mounting section in the apparatus body, is removed from the mounting section to extract the guide pipe from the supply port, the cover member, pressed into the holding section by the guide pipe, is urged by the holding member contained in the holding section, and the supply port is closed by the cover member.

In a case where printing is continuously done and in a case where purging is performed, therefore, even if the supply port is made large in order that the ink held in the holding member is sufficiently supplied to the recording head, the ink held in the holding member does not independently leak out of the supply port, so that stable recording can be made in such a manner that the ink does not leak.

In a case where the guide pipe is inserted into the supply port to press the cover member into the holding section as described above, if the amount of the pressed cover member is small, a sufficient amount of ink cannot be introduced into the recording head through the guide pipe. On the other hand, if the amount of the pressed cover member is too large, the cover member is deformed, and the holding member is interposed between the cover member and the supply port. Therefore, the cover member is generally pressed into the holding section by an amount in the range of 0.5 to 2.5 mm and preferably in the range of 1.0 to 2.0 mm.

In a case where the cover member is formed of a material having rubber elasticity, if the cover member is thin, the cover member may be damaged when it is pressed by the guide pipe as described above. On the other hand, if the cover member is too thick, the cover member may be shifted when it is pressed by the guide pipe. Therefore, the thickness of the cover member is selected to be in the range of 0.3 to 2.0 mm and preferably in the range of 0.5 to 1.0 mm.

Furthermore, in a case where the cover member is urged by the holding member to close the supply port, if an urging force produced by the holding member is too strong, the cover member is damaged when it is pressed upon inserting the guide pipe, and the cover member is difficult to press. On the other hand, if the urging force produced by the holding member is weak, the cover member is independently shifted from the supply port, so that the ink may leak. In containing the holding member in the holding section, therefore, the holding member is contained in the holding section upon being compressed in such a manner that the volume of the holding member is two-thirds to one-fourth and preferably two-fifths to two-sevenths of its original volume, and the cover member is urged by the thus compressed holding member to close the supply port.

In a second ink cartridge according to the present invention, a holding section, containing a holding member for holding ink, is provided in its cartridge body; and the holding section is provided with an opening. A supply pipe, for introducing the ink held in the holding section to the outside, is provided adjacent to the inner periphery of the opening so as to be axially movable. The supply pipe is urged toward the outside of the cartridge body by urging means.

In an ink supplying apparatus using the second ink cartridge, a mounting section, for holding the ink cartridge so as to be removable, and a connecting section, to which the supply pipe is connected, are provided in its apparatus body. The supply pipe is pressed into the holding section upon being pressed against the connecting section. The ink held in the holding section is introduced into a guide path, provided in the apparatus body, through the supply pipe.

The ink thus introduced into the guide path through the supply pipe is introduced into the recording head to make a recording.

When the supply pipe is pressed into the holding section as described above, the holding member contained in the holding section is compressed by the supply pipe, so that the ink held in the holding member is extruded. The ink is introduced into the guide path in the apparatus body through the supply pipe. Even in a case where printing is continuously done or in a case where purging is performed, therefore, a sufficient amount of ink is stably introduced into the recording head, thereby making it possible to make stable recording.

On the other hand, when the ink cartridge is removed from the mounting section in the apparatus body, the supply pipe, pressed into the holding section by the connecting section, is returned to its original state upon being urged by the urging means. When the supply pipe is thus returned to the original state, the holding member, compressed by the supply pipe, is returned to its original volume upon expanding. Consequently, the ink remaining in the supply pipe is sucked in by the holding member to prevent the ink from spilling from the ink cartridge.

In another ink supplying apparatus according to the present invention, an ink cartridge is held so as to be removable in a mounting section in its apparatus body. Ink supplied from the ink cartridge is introduced into a guide path, and air in the guide path is discharged through a discharge path connected to the guide path.

In a case where the ink cartridge is mounted on the mounting section in the apparatus body, therefore, even if air enters the guide path, the air is discharged through the discharge path upon being pressed by the ink supplied from the ink cartridge. Consequently, the possibility that the air entering the guide path is introduced into the recording head, so that the recording head is clogged with air bubbles as in the conventional example, is eliminated. Therefore, the ink is stably ejected from the recording head, making it possible to stably make good recording.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Preferred embodiments of the present invention will be specifically described on the basis of the drawings.

(First Embodiment)

Figure 1:
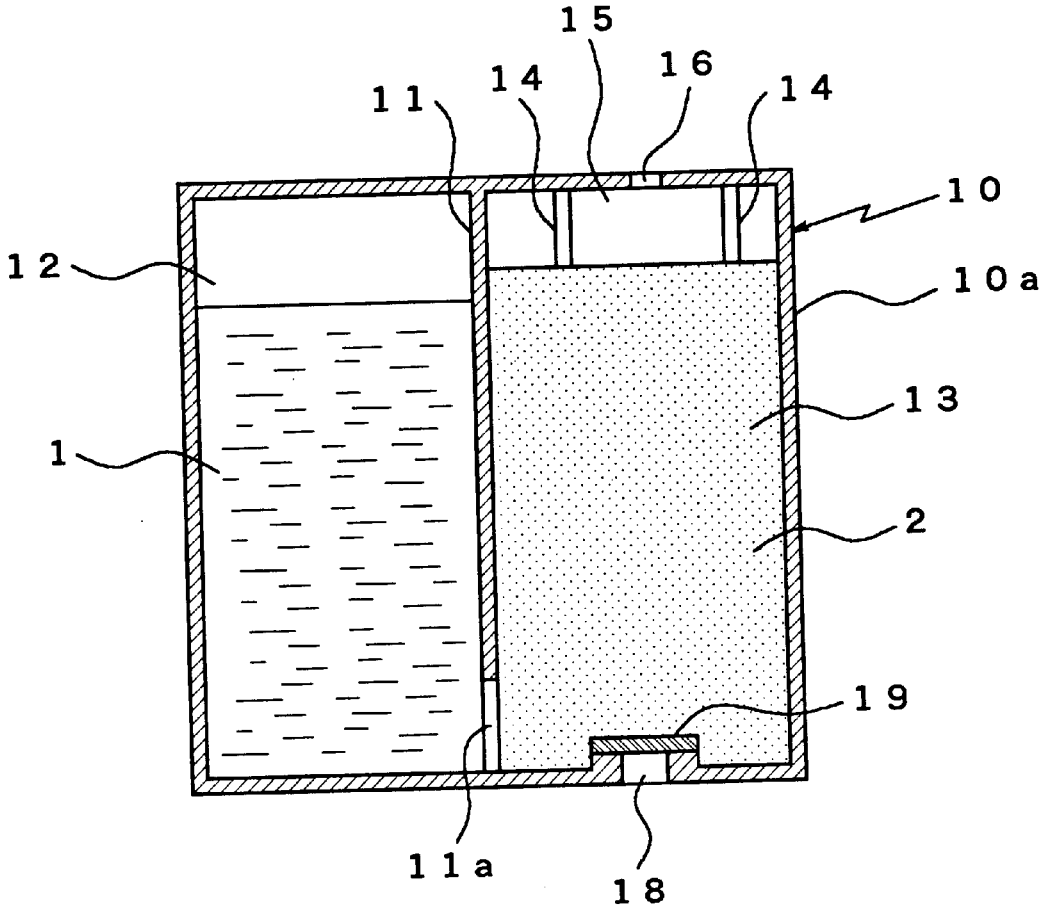
FIG. 1 is a cross-sectional view for explaining the internal construction of an ink cartridge used in a first embodiment of the present invention.

In the first embodiment, a cartridge body 10*a,* formed in the shape of a box having a height of 40 mm, a width of 40 mm and a depth of 15 mm, is used, as shown in FIG. 1, as an ink cartridge 10; and a barrier wall 11 is provided in the vertical direction in the cartridge body 10*a*.

The cartridge body 10*a* is divided by the barrier wall 11 into a containing section 12, for containing ink 1, and a holding section 13, containing a holding member 2 composed of a sponge for holding the ink 1; and a communicating port 11*a,* for causing the containing section 12 and the holding section 13 to communicate with each other, is provided in a lower part of the barrier wall 11.

A rib 14 is provided in an upper part of the holding section 13, and the holding member 2 is pressed by the rib 14. The holding member 2, whose uncompressed volume is twice the volume of the holding section 13, is contained in the holding section 13, and a space 15 is formed in an upper part of the holding section 13. An air hole 16 for introducing air into the cartridge body 10*a* is provided in the upper surface of the space 15.

Furthermore, a supply port 18, having a diameter of 4 mm for supplying the ink 1 to the outside, is so provided as to project into the holding section 13 from the bottom of the holding section 13 so that the distance from the bottom surface of the cartridge body 10*a* to the upper surface of the supply port 18 is 4 mm.

A part of a cover member 19, composed of a rubber packing 0.5 mm in thickness, is made to adhere to an edge of the upper surface of the supply port 18; and the cover member 19 is urged by the holding member 2, contained in the holding section 13, to close the supply port 18.

The ink 1 is contained in the containing section 12, and the ink 1 is introduced into the holding section 13 through the communicating port 11*a,* to hold the ink 1 in the holding member 2 which is contained in the holding section 13.

Figure 2:
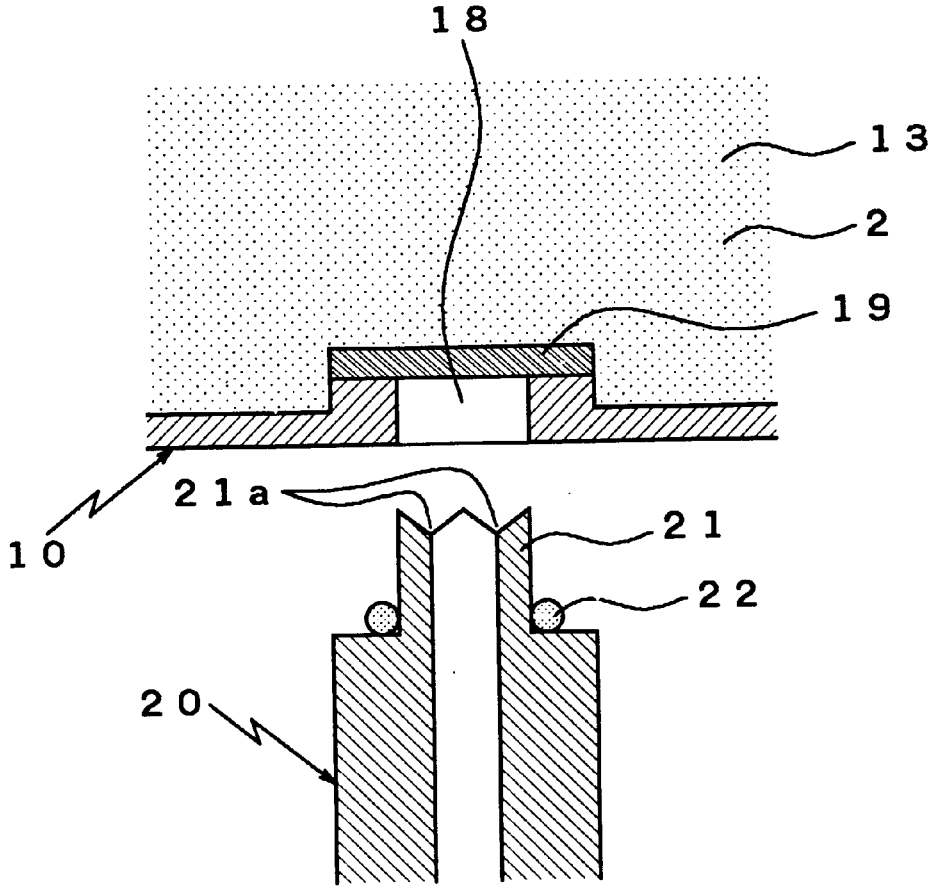
FIG. 2 is a fragmentary view for explaining a state before a guide pipe is mounted on a supply port of the ink cartridge in the first embodiment.
Figure 3:
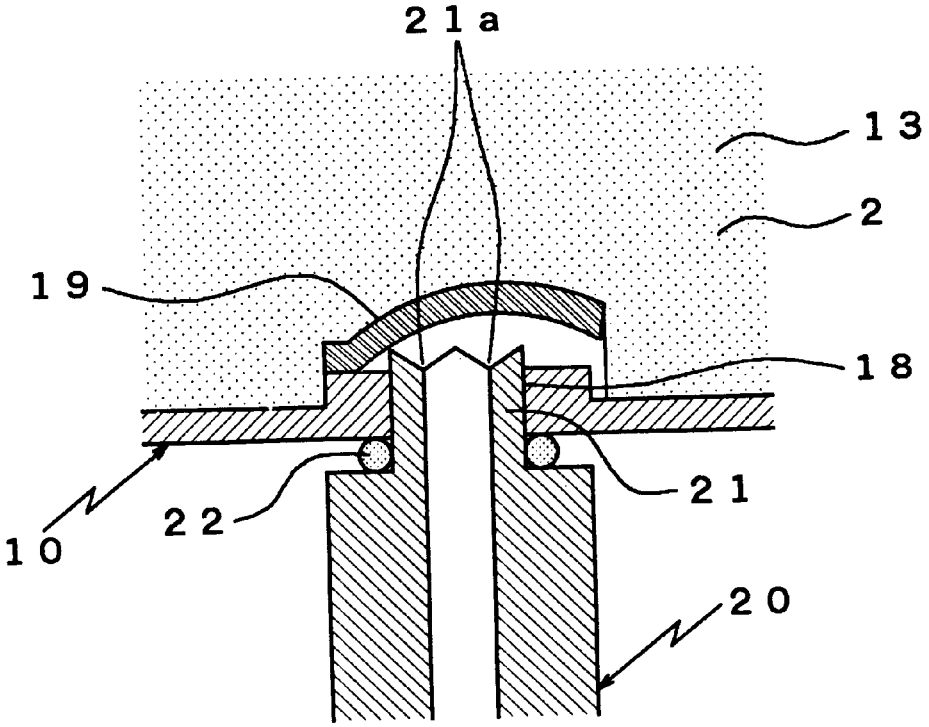
FIG. 3 is a fragmentary view for explaining a state where a guide pipe is mounted on a supply port of the ink cartridge in the first embodiment.

In the first embodiment, a mounting section (not shown) of an ink supplying apparatus, on which the ink cartridge 10 is mounted, is provided with a guide pipe 20 for guiding the ink 1. An example of the guide pipe 20 is one having a small diameter portion 21 provided at its leading end, whose outer diameter is smaller than the diameter of the supply port 18, a notch 21*a* being formed at a leading end of the small-diameter portion 21, as shown in FIGS. 2 and 3. An 0 ring 22 is mounted on the periphery of the small-diameter portion 21.

In the first embodiment, in supplying the ink 1 held in the holding member 2 to a recording head from the ink cartridge 10, the small-diameter portion 21 of the guide pipe 20 is inserted into the supply port 18, provided in the cartridge body 10*a;* the cover member 19, which has closed the supply port 18 as described above, is pushed up, against an urging force produced by the holding member 2, by the small-diameter portion 21; and the cover member 19 is pressed into the holding section 13 by 1 mm, to open the supply port 18, as shown in FIG. 3.

The ink 1 held in the holding member 2 is introduced into the guide pipe 20 through the notch 21*a* formed at the leading end of the small-diameter portion 21, and the ink 1 is supplied to the recording head through the guide pipe 20.

Even in a case where printing is continuously done and in a case where purging is performed, therefore, the ink 1 held in the holding member 2 is stably introduced into the recording head through the guide pipe 20, preventing insufficient printing, for example.

Although in the present embodiment, in providing the cover member 19 in an upper surface portion of the supply port 18, a part of the cover member 19 is made to adhere to the edge of the upper surface of the supply port 18, the cover member 19 can be also provided in such a manner as not to adhere to the edge of the upper surface of the supply port 18.

Figure 4:
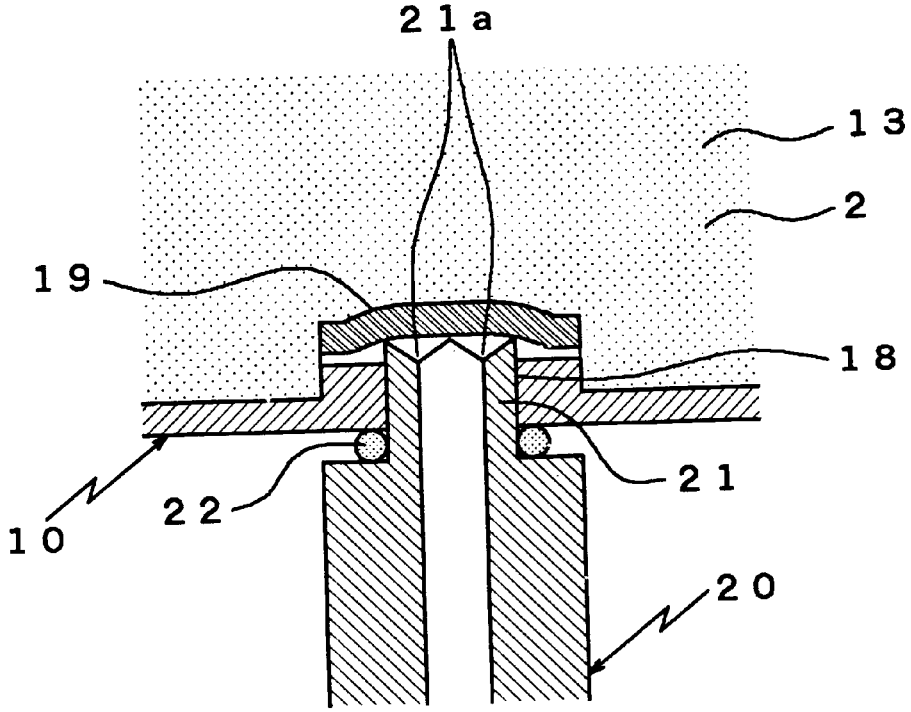
FIG. 4 is a fragmentary view for explaining a modified example in which a cover member does not adhere to an edge of the upper surface of a supply port in the first embodiment.

In a case where the cover member 19 does not adhere to the edge of the upper surface of the supply port 18, when the small-diameter portion 21 of the guide pipe 20 is inserted into the supply port 18 as described above, and the cover member 19 which has closed the supply port 18 is pressed into the holding section 13 against the urging force produced by the holding member 2 by the small-diameter portion 21, the entire cover member 19 is pushed up from the supply port 18 by the small-diameter portion 21, as shown in FIG. 4.

(Second Embodiment)

In the second embodiment, an ink cartridge 10, obtained by changing the supply port 18 provided at the bottom of the holding section 13 in the cartridge body 10*a* in the above-mentioned first embodiment, is used.

Figure 5:
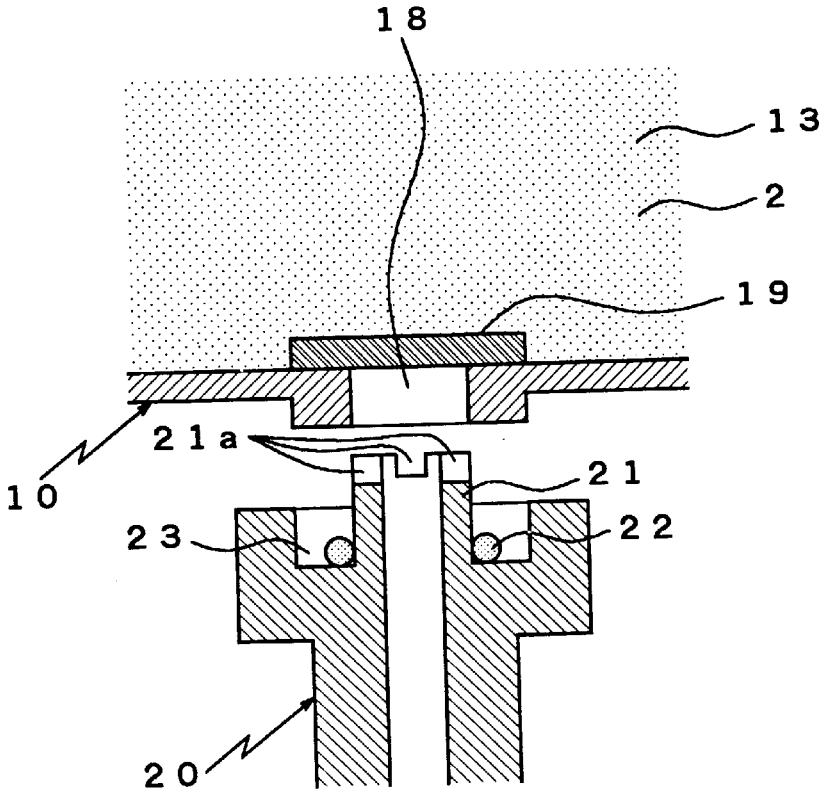
FIG. 5 is a fragmentary view for explaining a state before a guide pipe is mounted on a supply port of an ink cartridge in a second embodiment of the present invention.

In an ink cartridge 10 in the second embodiment, a supply port 18 having a diameter of 4 mm is so provided as to project downwardly from the bottom surface of its cartridge body 10*a* so that the distance between the lower surface and the upper surface of the supply port 18 is 4 mm, as shown in FIG. 5. A part of a cover member 19, composed of a rubber packing 0.5 mm in thickness, is made to adhere to an edge of the upper surface of the supply port 18, as in the above-mentioned first embodiment; and the cover member 19 is urged by the holding member 2, contained in the holding section 13, to close the supply port 18.

In the second embodiment, an example of a guide pipe 20 for guiding ink 1 is one having a small-diameter portion 21, provided at its leading end, whose outer diameter is smaller than the diameter of the supply port 18, a notch 21*a* being formed at a leading end of the small-diameter portion 21, and being provided with a fitting section 23 in which a portion of the supply port 18 projecting downwardly from the cartridge body 10*a* as described above is fitted. In the fitting section 23, an 0 ring 22 is mounted on the periphery of the small-diameter portion 21.

In the second embodiment, in supplying the ink 1 held in the holding member 2 to a recording head from the ink cartridge 10, the small-diameter portion 21 of the guide pipe 20 is inserted into the supply port 18 provided in the cartridge body 10*a,* and the portion of the supply port 18 projecting downwardly from the cartridge body 10*a* is fitted in the fitting section 23.

The cover member 19, which has closed the supply port 18, is pressed by the small-diameter portion 21, inserted into the supply port 18, into the holding section 13 a distance of 2 mm, against an urging force produced by the holding member 2, to open the supply port 18. The ink 1, held in the holding member 2, is introduced into the guide pipe 20 through the notch 21*a,* formed at the leading end of the small-diameter portion 21; and the ink 1 is supplied to the recording head through the guide pipe 20.

Even in a case where printing is continuously done and in a case where purging is performed, therefore, the ink 1, held in the holding member 2, is stably introduced into the recording head through the guide pipe 20, preventing insufficient printing, for example, as in the above-mentioned first embodiment.

Figure 6:
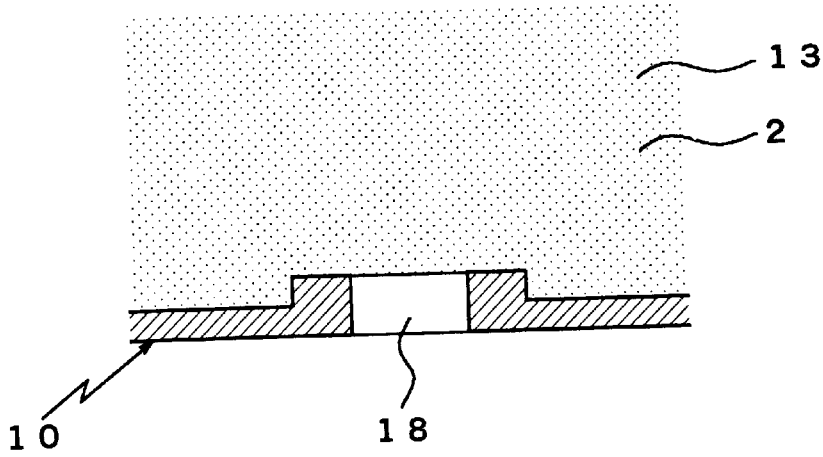
FIG. 6 is a fragmentary view for explaining the structure of a portion of a supply port of an ink cartridge in a first comparative example.

The respective ink cartridges 10 used in the above-mentioned first and second embodiments and an ink cartridge 10 in a first comparative example in which the cover member 19 in the ink cartridge 10 in the first embodiment is not provided, as shown in FIG. 6, were then used, to examine leakage of the ink in each of the ink cartridges 10.

In a case where the temperature was changed from 0° C. to 35° C. in a state where the supply port 18 in each of the ink cartridges 10 in the first and second embodiments and the first comparative example was directed downwardly and in a case where the ink cartridges 10 were dropped, the leakage of the ink in each of the ink cartridges 10 was examined, and the results thereof are shown in the following Table 1. As to the evaluation of the leakage of the ink, a case where no ink leaked is indicated by o, and a case where ink leaked was indicated by x:

TABLE 1

| ink leakage measuring conditions | first embodiment | second embodiment | first comparative example |
|---|---|---|---|
| temperature change | o | o | x |
| drop | o | o | x |

As a result, in the ink cartridge 10 in the first comparative example in which the cover member 19 for closing the supply port 18 is not provided, ink leaked under each of the above-mentioned measuring conditions. On the other hand, in each of the ink cartridges of the first and second embodiments, no ink leaked under either of the measuring conditions.

(Third Embodiment)

Figure 7:
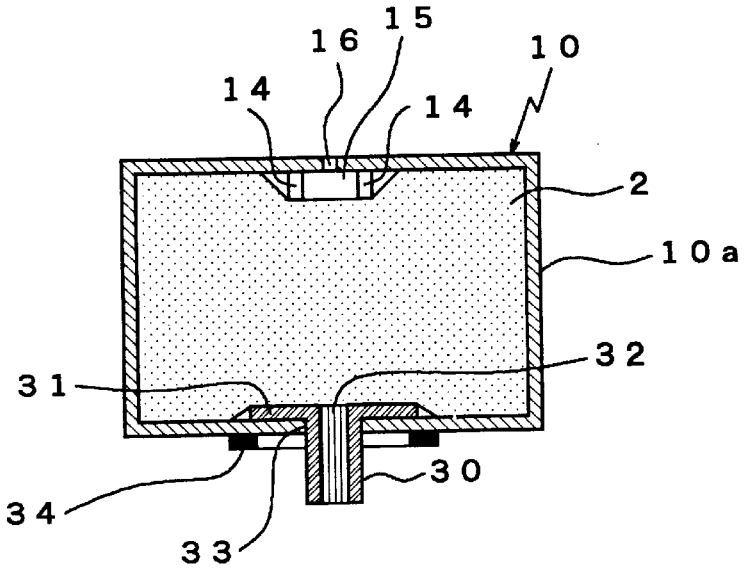
FIG. 7 is a cross-sectional view for explaining the internal construction of an ink cartridge used in a third embodiment of the present invention.

In a third embodiment, an ink cartridge 10 shown in FIG. 7 is used.

In the ink cartridge 10, a holding member 2, such as a urethane foam holding ink, is held in its cartridge body 10*a,* and a rib 14 is provided on the upper surface of the inside of the cartridge body 10*a* so as to project downwardly. The holding member 2 is pushed down upon being compressed by the rib 14, to provide a space 15 in an upper part of the cartridge body 10*a*. An air hole 16 for introducing air into the space 15 is provided on the upper surface of the cartridge body 10*a*.

In the ink cartridge 10, an example of a supply pipe 30, for supplying the ink contained in the cartridge body 10*a* to the outside, is one in a cylindrical shape, having a collar 31 provided at its upper end positioned inside the cartridge body 10*a,* and filled with a fiber member 32. The supply pipe 30 is brought into close contact with the inner periphery of an opening 33, provided at the bottom of the cartridge body 10*a;* the supply pipe 30 is mounted on the opening 33 so as to be vertically movable in such a manner that the ink does not leak out of a portion between the supply pipe 30 and the opening 33; and the supply pipe 30 is pressed downwardly by the holding member 2.

Figure 8:
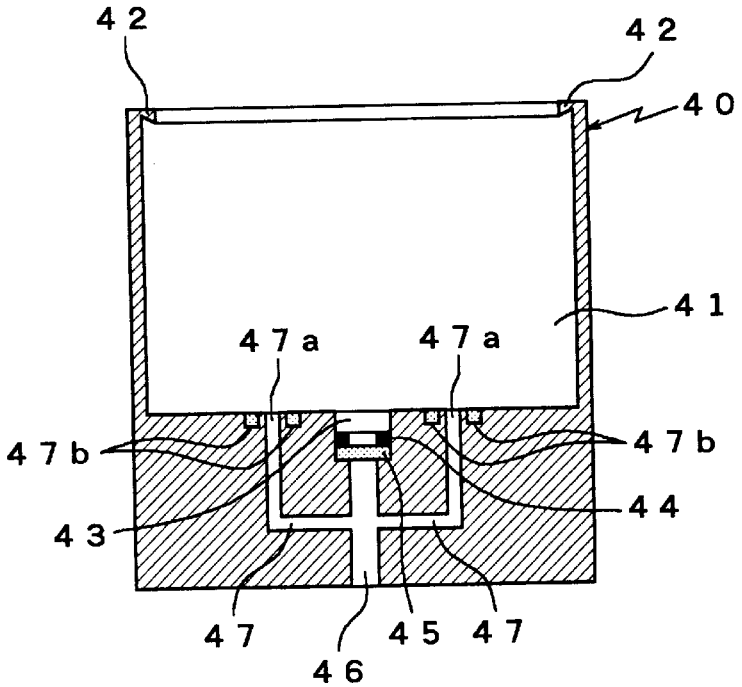
FIG. 8 is a cross-sectional view for explaining an apparatus body of an ink supplying apparatus on which the ink cartridge is mounted in the third embodiment.

On the other hand, in an apparatus body 40 of an ink supplying apparatus on which the above-mentioned ink cartridge 10 is mounted, there is provided a mounting section 41, having an opened upper surface on which the ink cartridge 10 is mounted so as to be removable; and an engaging claw 42, for holding the ink cartridge 10 in the mounting section 41, is provided at an upper end of the mounting section 41, as shown in FIG. 8. Further, a connecting section 43, to which the supply pipe 30 in the ink cartridge 10 is connected upon being inserted, is provided at the bottom of the mounting section 41.

A ring-shaped packing member 44 and a filter 45 are provided in the connecting section 43; and a guide path 46, for guiding the ink supplied from the supply pipe 30, is so provided as to communicate with the connecting section 43. The packing member 44 is brought into close contact with the periphery of the lower surface of the supply pipe 30 to prevent the ink from leaking, and the filter 45 prevents dust or the like, from entering the guide path 46 together with the ink.

In the above-mentioned apparatus body 40, a discharge path 47, for discharging air flowing into the guide path 46, is connected to the guide path 46; and an absorbing member 47*b* is provided around a discharge port 47*a* of the discharge path 47. When ink, together with air, is discharged from the discharge port 47*a* through the discharge path 47, the absorbing member 47*b* absorbs the ink.

On the other hand, in the above-mentioned ink cartridge 10, a packing member 34, for sealing the discharge port 47*a,* is provided around the supply pipe 30 in such a manner as to correspond to the discharge port 47*a* of the discharge path 47, as shown in FIG. 7.

Figure 9:
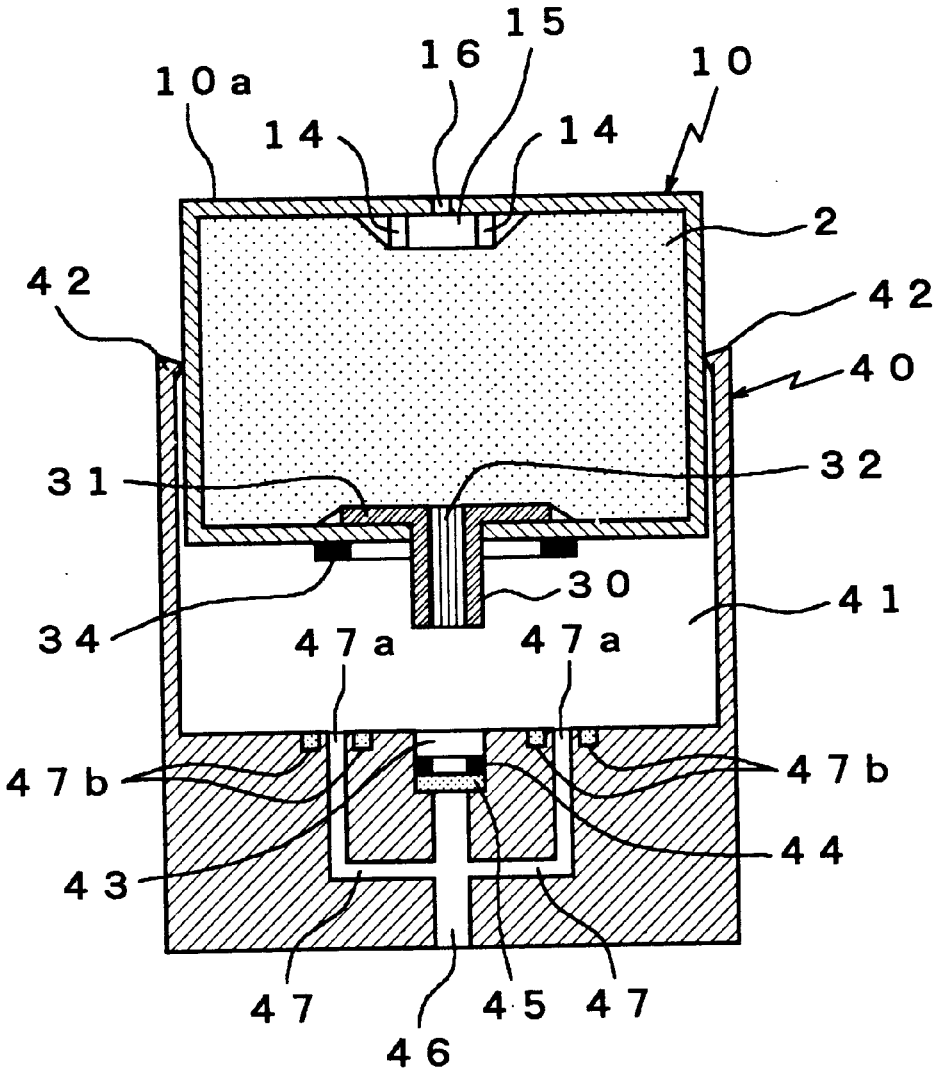
FIG. 9 is a cross-sectional view for explaining a state where the ink cartridge is being mounted on a mounting section in the apparatus body in the third embodiment.

In the third embodiment, in mounting the ink cartridge 10 on the mounting section 41 in the apparatus body 40, the ink cartridge 10 is inserted into the mounting section 41 in the apparatus body 40; and the supply pipe 30, projecting from the bottom of the ink cartridge 10, is inserted into the connecting section 43, provided in the apparatus body 40, as shown in FIG. 9.

Even after the periphery of the lower surface of the supply pipe 30 abuts against the packing member 44, provided in the connecting section 43, by thus inserting the supply pipe 30 in the ink cartridge 10 into the connecting section 43 in the apparatus body 40, the ink cartridge 10 is pressed into the mounting section 41 in the apparatus body 40.

Figure 10:
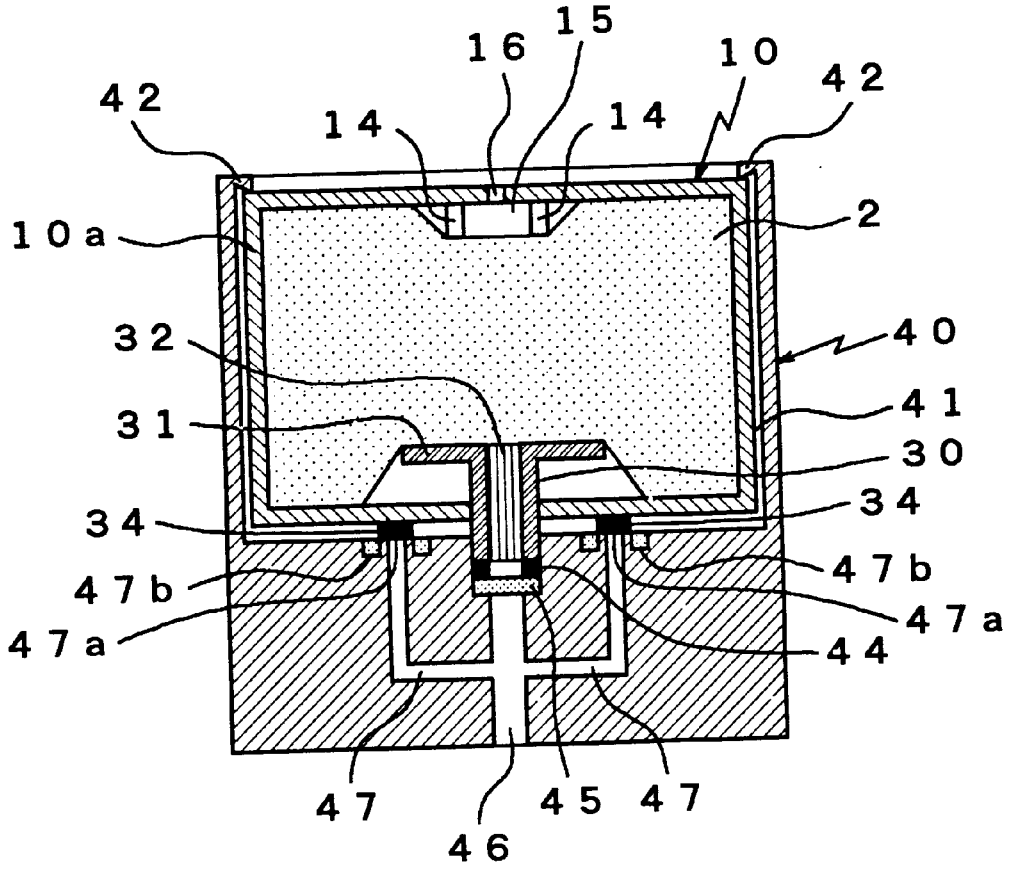
FIG. 10 is a cross-sectional view for explaining a state where the ink cartridge is mounted on a mounting section in the apparatus body in the third embodiment.

In a state where the supply pipe 30 in the ink cartridge 10 is stopped upon abutting against the packing member 44, therefore, the ink cartridge 10 is further lowered. Consequently, the supply pipe 30 is pressed into the cartridge body 10*a,* the holding member 2 contained in the cartridge body 10*a* is compressed by the supply pipe 30, and the ink held in the holding member 2 is ejected and is introduced into the connecting section 43 in the apparatus body 40 through the supply pipe 30, as shown in FIG. 10.

The ink, thus introduced into the connecting section 43 through the supply pipe 30, is introduced into the guide path 46, communicating with the connecting section 43; air, entering the guide path 46, is pushed by the ink; and the air is discharged through the discharge path 47, connected to the guide path 46, from the discharge port 47*a*. In a case where the air in the guide path 46 is thus discharged, even if the ink introduced into the guide path 46, together with the air, is discharged from the discharge port 47*a* through the discharge path 47, the ink is absorbed by the absorbing member 47*b,* provided around the discharge port 47*a*.

When the ink cartridge 10 is further pressed into the mounting section 41 in the apparatus body 40, the discharge port 47*a* of the discharge path 47 is closed by the packing member 34, provided around the supply pipe 30, so that the ink introduced into the guide path 46 is not discharged through the discharge port 47*a* of the discharge path 47. Further, when the ink cartridge 10 is pressed into the mounting section 41 beyond the engaging claw 42, provided at the upper end of the mounting section 41, the ink cartridge 10 is held in the mounting section 41 upon being engaged by the engaging claw 42.

In the third embodiment, in a state where the ink cartridge 10 is held in the mounting section 41 in the apparatus body 40 as described above, the ink is introduced into the guide path 46 through the connecting section 43, provided in the apparatus body 40, from the supply pipe 30; and the ink is introduced into a recording head (not shown) through the guide path 46 to make a recording.

In such a case, the air entering the guide path 46 is discharged through the discharge path 47 as described above. Accordingly, the possibility that the air is introduced into the recording head, so that the recording head is clogged with air bubbles, is eliminated. Therefore, the ink is stably ejected from the recording head, preventing insufficient printing. Consequently, good recording can be stably made.

When the ink cartridge 10 held in the mounting section 41 in the apparatus body 40 in the above-mentioned manner is removed from the mounting section 41, the upper end of the mounting section 41 in the apparatus body 40 is enlarged to release the engagement of the ink cartridge 10 by the engaging claw 42, to extract the ink cartridge 10 from the mounting section 41 in the apparatus body 40.

Consequently, the supply pipe 30, pressed into the cartridge body 10*a,* is pushed back by the holding member 2, contained in the cartridge body 10*a;* the holding member 2, compressed by the supply pipe 30, expands; and the ink, remaining in the supply pipe 30, is sucked in by the holding member 2 so as not to spill.

(Fourth Embodiment)

Figure 11:
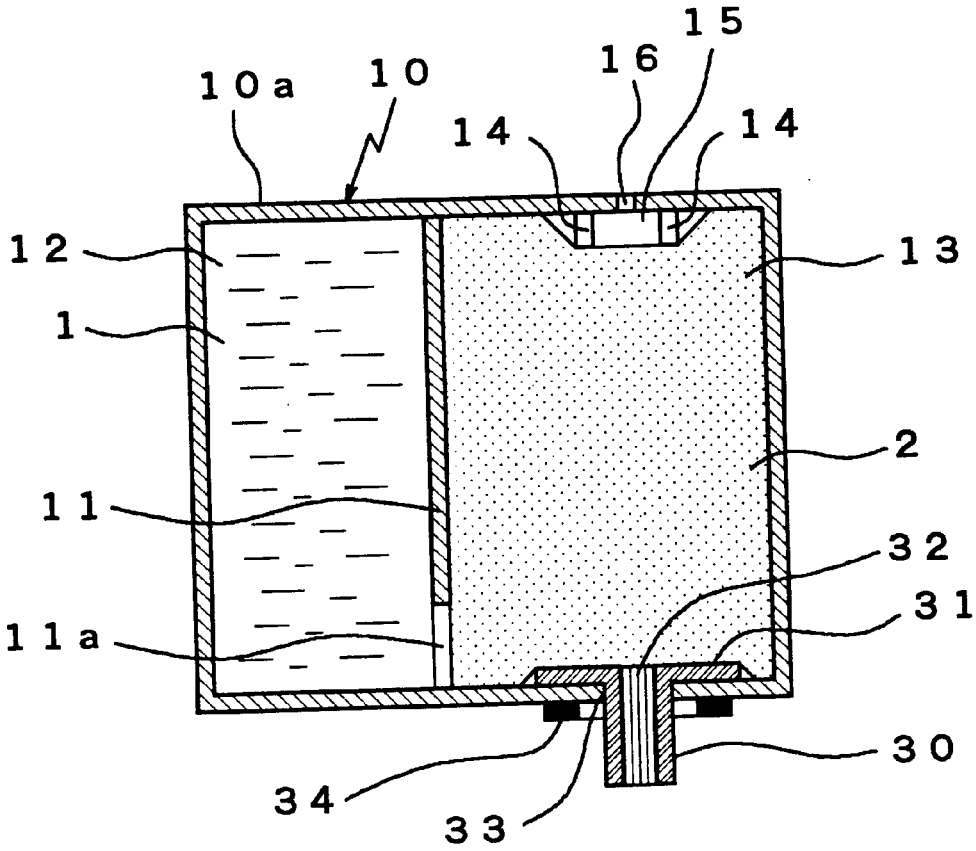
FIG. 11 is a cross-sectional view for explaining the internal construction of an ink cartridge used in a fourth embodiment of the present invention.

In a fourth embodiment, an ink cartridge 10, shown in FIG. 11, is used.

In the ink cartridge 10, a vertically extending barrier wall 11 is provided inside its cartridge body 10*a.* The ink cartridge 10 is divided by the barrier wall 11 into a containing section 12, for containing ink 1, and a holding section 13, containing a holding member 2 for holding the ink 1; and a communicating port 11*a,* for causing the containing section 12 and the holding section 13 to communicate with each other, is provided below the barrier wall 11.

In the ink cartridge 10, a rib 14 is provided on the upper surface of the holding section 13 in the cartridge body 10*a* so as to project downwardly. The holding member 2 is pushed downwardly by the rib 14 to provide a space 15. An air hole 16, for introducing air into the space 15, is provided on the upper surface of the holding section 13.

In the ink cartridge 10, an example of a supply pipe 30, for supplying the ink contained in the cartridge body 10*a* to the outside, is one in a cylindrical shape, having a collar 31 provided at its upper end positioned in the cartridge body 10*a,* and filled with a fiber member 32. The supply pipe 30 is brought into close contact with the inner periphery of an opening 33, provided at the bottom of the cartridge body 10*a;* the supply pipe 30 is mounted on the opening 33 so as to be vertically movable in such a manner that the ink does not leak out of a portion between the supply pipe 30 and the opening 33; and the supply pipe 30 is pressed downwardly by the holding member 2.

On the other hand, an example of an apparatus body 40, of an ink supplying apparatus on which the ink cartridge 10 is mounted, is one which is constructed almost similarly to the apparatus body 40 in the above-mentioned third embodiment.

Figure 12:
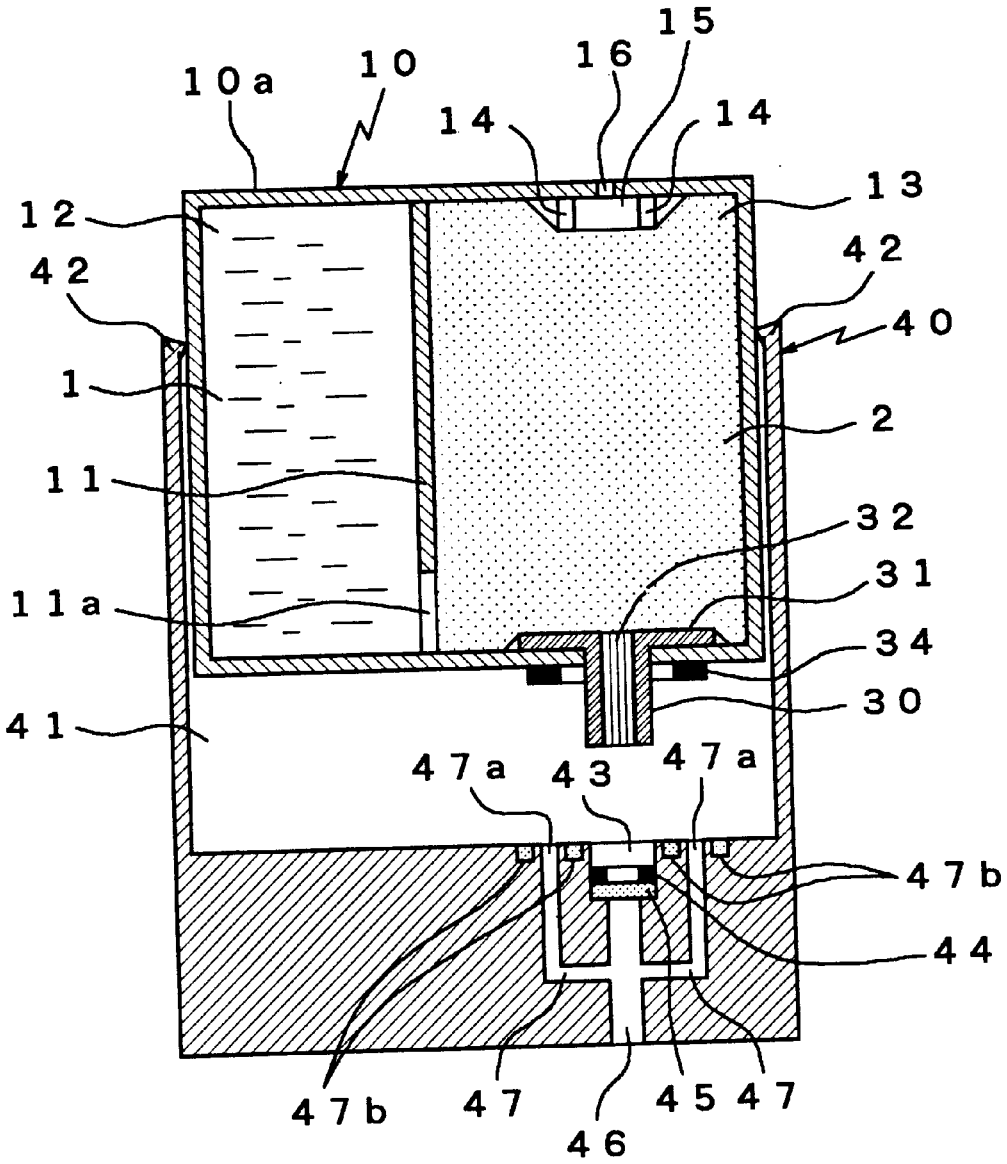
FIG. 12 is a cross-sectional view for explaining a state where the ink cartridge is being mounted on a mounting section in an apparatus body of an ink supplying apparatus in the fourth embodiment.
Figure 13:
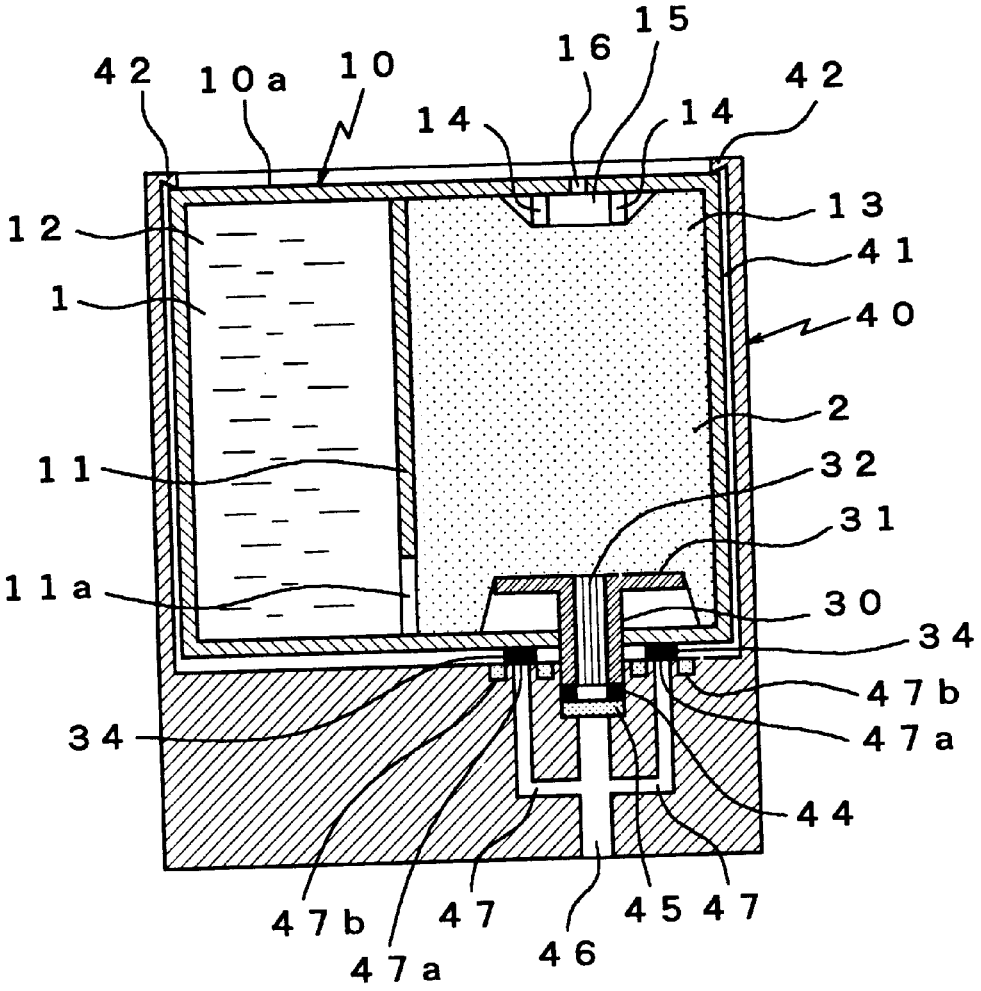
FIG. 13 is a cross-sectional view for explaining a state where the ink cartridge is mounted on the mounting section in the apparatus body in the fourth embodiment.

In the present fourth embodiment, in mounting the ink cartridge 10 on the mounting section 41 in the apparatus body 40, the ink cartridge 10 is inserted into the mounting section 41, provided in the apparatus body 40; and the supply pipe 30, projecting from the bottom of the ink cartridge 10, is inserted into a connecting section 43, provided in the apparatus body 40, as shown in FIGS. 12 and 13.

Even after the periphery of the lower surface of the supply pipe 30 abuts against a packing member 44, provided in the connecting section 43, by thus inserting the supply pipe 30 in the ink cartridge 10 into the connecting section 43 in the apparatus body 40, the ink cartridge 10 is pressed into the mounting section 41 in the apparatus body 40, as in the above-mentioned third embodiment.

In a state where the supply pipe 30 in the ink cartridge 10 is stopped upon abutting against the packing member 44, therefore, the ink cartridge 10 is further lowered. Consequently, the supply pipe 30 is pressed into the cartridge body 10*a;* the holding member 2, contained in the cartridge body 10*a,* is compressed by the supply pipe 30; and the ink, held in the holding member 2, is extruded and is introduced into the connecting section 43 in the apparatus body 40 through the supply pipe 30, as in the above-mentioned third embodiment.

The ink, thus introduced into the connecting section 43 through the supply pipe 30, is introduced into a guide path 46, communicating with the connecting section 43; air entering the guide path 46 is pushed by the ink; and the air is discharged through a discharge path 47, connected to the guide path 46 from its discharge port 47*a*. In a case where the air in the guide path 46 is thus discharged, even if the ink introduced into the guide path 46, together with the air, is discharged from the discharge port 47*a* through the discharge path 47, the ink is absorbed by an absorbing member 47*b,* provided around the discharge port 47*a*.

When the ink cartridge 10 is further pressed into the mounting section 41 in the apparatus body 40, the discharge port 47*a* of the discharge path 47 is closed by a packing member 34, provided around the supply pipe 30, so that the ink, introduced into the guide path 46, is not discharged through the discharge port 47*a* of the discharge path 47. Further, when the ink cartridge 10 is pressed into the mounting section 41 beyond an engaging claw 42, provided at an upper end of the mounting section 41, the ink cartridge 10 is held in the mounting section 41 upon being engaged by the engaging claw 42.

Also in the fourth embodiment, in a state where the ink cartridge 10 is mounted on the apparatus body 40, the ink is introduced into the guide path 46 through the connecting section 43, provided in the apparatus body 40, from the supply pipe 30; and the ink is introduced into a recording head (not shown) through the guide path 46 to make a recording, as in the above-mentioned third embodiment.

In such a case, the air entering the guide path 46 is discharged through the discharge path 47 as described above. Accordingly, the possibility that the air is introduced into the recording head, so that the recording head is clogged with air bubbles, is eliminated. Therefore, the ink is stably ejected from the recording head, preventing insufficient printing. Consequently, good recording can be stably made.

When the ink cartridge 10, held in the mounting section 41 in the apparatus body 40 in the above-mentioned manner, is removed from the mounting section 41, the upper end of the mounting section 41 in the apparatus body 40 is enlarged to release the engagement of the ink cartridge 10 by the engaging claw 42, to extract the ink cartridge 10 from the mounting section 41 in the apparatus body 40.

Consequently, the supply pipe 30 pressed into the cartridge body 10*a* is pushed back by the holding member 2, contained in the cartridge body 10*a;* the holding member 2, compressed by the supply pipe 30, expands; and the ink, remaining in the supply pipe 30, is sucked in by the holding member 2 so as not to spill.

Although in the above-mentioned fourth embodiment, the barrier wall 11 is provided in the vertical direction in the ink cartridge 10, the barrier wall 11 need not necessarily be provided in the vertical direction. The barrier wall can be also provided in the horizontal direction in the ink cartridge, to divide the cartridge body into upper and lower parts, and to provide the holding section, containing the holding member, for holding the ink below the containing section for containing the ink, which is not illustrated.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An ink cartridge comprising:

a cartridge body, having a holding section for holding ink;

a supply port, formed in said holding section, for introducing the ink to the outside;

a cover member, provided in said holding section, for opening and closing said supply port; and a holding member, contained in said holding section, for holding the ink and for urging said cover member toward the supply port.

2. An ink cartridge according to claim 1, wherein said cover member is composed of an elastic member having a thickness in the range of 0.3 to 2.0 mm.

3. An ink cartridge according to claim 2, wherein said cover member has a part thereof adhering to an edge of said supply port.

4. An ink cartridge according to claim 1, wherein said holding member is contained in said holding section upon being compressed into a volume which is two-thirds to one-fourth of the original volume of said holding member.

5. An ink cartridge according to claim 4, wherein said holding section is provided with an air hole communicating with the outside, a space being formed between the air hole and the holding member.

6. An ink cartridge according to claim 1, wherein a containing section, separated from said holding section by a barrier wall, for containing ink, is provided in said cartridge body, said holding section and the containing section communicating with each other by a communication port provided in the barrier wall.

7. An ink supplying apparatus comprising:

an ink cartridge comprising a cartridge body, having a holding section for holding ink, a supply port, formed in said holding section, for introducing the ink to the outside, a cover member, provided in said holding section, for opening and closing said supply port, and a holding member, contained in said holding section, for holding the ink and for urging said cover member toward the supply port; and an apparatus body comprising a mounting section for holding said ink cartridge so as to be removable, and a guide pipe, provided in said mounting section, for guiding the ink, the guide pipe being inserted into the supply port, provided in said ink cartridge, to press said cover member into said holding section to open the supply port.

8. An ink supplying apparatus according to claim 7, wherein said guide pipe is inserted into said supply port, to press said cover member into the holding section by an amount in the range of 0.5 to 2.5 mm.

* * * * *